US005215136A

United States Patent [19]

Flanders et al.

[11] Patent Number: 5,215,136

[45] Date of Patent: Jun. 1, 1993

[54] COMBINATION PUTTER COVER AND GOLF BALL WASHER

[76] Inventors: David E. Flanders; Denis R. Lanigan, both of 10085 Rio San Diego Dr., #348, San Diego, Calif. 92108

[21] Appl. No.: 610,788

[22] Filed: Nov. 8, 1990

[51] Int. Cl.[5] ..... A63B 57/00

[52] U.S. Cl. ..... 150/160; 206/315.2; 206/315.9

[58] Field of Search ..... 150/154, 159, 160; 206/315.2, 315.4, 315.9; 15/209 R; D21/221

[56] References Cited

U.S. PATENT DOCUMENTS

| | | | |
|---|---|---|---|
| D. 318,705 | 7/1991 | Arato | D21/221 |
| 2,737,394 | 3/1956 | Abel | 150/160 X |
| 2,782,912 | 2/1957 | Humphrey | 2/158 X |
| 2,968,825 | 1/1961 | Wetherby | 206/315.9 X |
| 3,253,628 | 5/1966 | Koetting | 150/160 |
| 3,303,865 | 2/1967 | Ouimet | 150/160 |
| 3,406,419 | 10/1968 | Young | 150/160 X |
| 3,492,746 | 2/1970 | Hauck | 150/160 X |
| 3,727,659 | 4/1973 | Shuford | 150/160 |
| 4,498,579 | 2/1985 | Brick | 150/159 X |
| 4,971,126 | 11/1990 | Borenstein | 150/160 |

FOREIGN PATENT DOCUMENTS

| | | | |
|---|---|---|---|
| 12382 | 1/1914 | United Kingdom | 206/315.2 |
| 207370 | 11/1923 | United Kingdom | 206/315.4 |
| 365226 | 1/1932 | United Kingdom | 206/315.3 |

*Primary Examiner*—Sue A. Weaver

[57] ABSTRACT

A knitted fabric cylinder is folded, rolled, reversed, and, preferably, sewn so as to contain two compartments, one of which is waterproof. It appears similar to, and functions as an ordinary knit putter cover, but can also be used to wash golf balls. The waterproof compartment is lined with a non-absorbent yarn, typically polyester, to facilitate the washing of golf balls. The other compartment is lined with an absorbent yarn, typically acrylic, and will stretch to conform the shape of an inserted putter head. A moisture barrier, preferably of molded synthetic rubber, backs the fabric of the waterproof washing compartment in order to securely retain detergent solution introduced into the washing compartment. A golf ball is inserted into the washing compartment and manually manipulated to wipe stains and debris from the surface of the ball. A putter head is received into a separate, knit fabric lined, putter compartment. Each of the exterior, the ball washing compartment liner and the putter compartment liner, are fabricated from selected textile yarns and weaves as a single tubular-shaped unit made on a cylindrical knitting machine.

7 Claims, 4 Drawing Sheets

COMBINATION PUTTER COVER AND GOLF BALL WASHER

BACKGROUND OF THE INVENTION

1. Field of the Invention

The present invention generally relates to small, hand-held or otherwise portable devices employed to clean golf balls, and more particularly relates to a golf ball washer made from flexible materials and functioning as a putter head cover.

2. Background of the Invention

Golfers find it advantageous during play to frequently remove surface stains, dirt and/or debris from their golf balls. Golfers clean their golf balls because extraneous materials on the surface of a golf ball may cause the ball to veer from a true line when putted or struck with a club, and because clean golf balls can be maintained in playable condition for longer periods.

Although some golf courses provide stationary golf ball cleaning equipment at various fixed, specific locations throughout the field of play, not all courses do. Some courses which make equipment available do not place equipment at each hole. Golf ball cleaning equipment provided on the golf course are typically placed in the general areas of the teeing grounds, and is frequently not located conveniently for all golfers due to the use of multiple teeing grounds for a single hole.

Conventional freestanding golf ball cleaning equipment is not normally located near greens because such equipment is prone to be struck with approach shots in such locations, thereby presenting an undesirable element of randomness, or luck, to the game of golf. Despite the general unavailability of golf ball cleaning equipment in locations proximate to the greens, it is exactly in these locations where a golf ball that has been dirtied from play on a golf hole would desirably be cleaned. Golfers strongly desire a clean ball during the intricate, and precise, putting strokes.

Even when course-provided equipment is conveniently located on each hole, it may not be in proper working order. The cleaning equipment may either be mechanically inoperative, or simply nonfunctional due to an absence of cleaning solution.

Although various portable golf ball washer designs exist, most require a golfer to use a separate towel for the purpose of drying a ball after washing. Portable golf ball washers which do not require the use of a separate towel generally require the use of dangerous, expensive, and typically flammable drying agents. Also heretofore, portable ball washers have frequently leaked or dripped on hands, gloves, clothing and equipment during routine use. Most portable ball washers are intended to be attached to golf bags or golf carts. Consequently, they cannot be conveniently carried in the golfer's pockets, or easily taken onto the greens where they are critically needed.

Most recreational golfers having a dirty golf ball in play on a green will attempt to clean the ball by wetting it with saliva and wiping the wetted ball on clothing or on the grass, or will replace the dirty ball with a clean ball in violation of the rules of golf. Although such methods of cleaning are either unsanitary or unsportsmanlike, it is scarcely more desirable to putt with a dirty ball. Short of enjoying the attentions of a caddy to clean the ball by wetting and wiping it with separate towels, there is no favorable alternative to having and using a ball washer on the green.

Still further heretofore, portable golf ball washers could not themselves be washed and maintained without messy and laborious manual cleaning.

Accordingly, it would be desirable to provide a portable golf ball washer having a washing chamber that is highly effective to remove stains, dirt, mud or other debris from the surface of a golf ball wheresoever the golf ball is located. Such a portable golf ball washer would desirably be easily manually operated independently of the availability, location or condition of stationary ball washing equipment, sources of water, etc. on golf courses.

It is further desirable to provide a golf ball washer having either a washing chamber extended or expanded into regions which would be suitable for drying a washed golf ball, or else having a region of additional material exterior to the washing chamber that would be suitable for drying a washed golf ball, or having both such regions. Such a golf ball washer would therefore not require golfers to carry a separate drying towel.

It is still further desirable to provide a soft, flexible, and lightweight golf ball washer which, when not employed for washing golf balls, could easily and comfortably be carried in a golfer's pocket while he or she was on a green or anywhere throughout the field of play. Despite such easy portability, the golf ball washer should not require replacement or replenishment of cleaning fluid during routine use. It should never leak on the golfer's hands, clothing or equipment.

It is still further desirable to provide a golf ball washer which, by virtue of its flexibility, could serve an alternative purpose, such as, for example, providing a protective and decorative covering for the head of a putter or other golf club. Such a dual purpose cleaner and cover would necessarily accommodate various sizes and styles of putter heads. As such a dual purpose item, a portable golf ball washer could particularly easily, and routinely, be carried onto golf course greens in conjunction with the golfer's putter where it could be used to wash the golfer's golf ball prior to the putting stroke(s).

It is still further desirable to provide a golf ball washer which could be easily cleaned and maintained in good working order by means of conventional machine washing and machine tumble drying along with other ordinary laundry items.

SUMMARY OF THE INVENTION

A knitted fabric cylinder is folded, rolled, reversed, and, preferably, sewn so as to contain two compartments, one of which is waterproof. It appears similar to, and functions as an ordinary knit putter cover, but can also be used to wash golf balls. The waterproof compartment is lined with a non-absorbent yarn, typically polyester, to facilitate the washing of golf balls. The other compartment is lined with an absorbent yarn, typically acrylic, and will stretch to conform the shape of an inserted putter head. A moisture barrier, preferably of molded synthetic rubber, backs the fabric of the waterproof washing compartment in order to securely retain detergent solution introduced into the washing compartment. A golf ball is inserted into the washing compartment and manually manipulated to wipe stains and debris from the surface of the ball. A putter head is received into a separate, knit fabric lined, putter compartment. Each of the exterior, the ball washing compartment liner and the putter compartment liner, are fabricated from selected textile yarns and weaves as a single tubular-shaped unit made on a cylindrical knitting machine.

In one of its embodiments of the invention the invention is a multi-layered generally-elongate double-end-opening pouch for cleaning articles such as golf balls and the like. To make this pouch an elongate fabric tube of length 3L, having at least one closed end in the manner of a sock, is folded and rolled to a generally tubular form of approximately length L. The tubular form has an defines two separate fabric-lined cavities proceeding for the substantial entirety of the length L from openings at both ends. At least one of the defined cavities has a bottom that is closed because it is formed from the closed end of the elongate fabric tube from which the tubular form is folded and rolled. A flexible waterproof elongate tubular bladder, also having at least one closed end in the manner of a sock and having a length approximately equal to L, is completely contained within the folded and rolled tubular form of the fabric tube in a position exterior to, and sheathing, the fabric lining of the at least one cavity of the tubular form fabric tube that is closed.

By this construction the at least one fabric-lined cavity that is closed will hold fluid because it is sheathed with the elongate bladder. This fabric-lined cavity that will hold fluid may suitably be saturated with fluid, inserted with a foreign article, and manually massaged to provide a cleaning action to the foreign article. The remaining cavity that proceeds from the remaining open end of the tubular form is suitably sized and shaped so as to slip over the head of a golf club, thereafter to retain both the tubular form and also the bladder to the head of said golf club.

These and other objects and features of the present invention will become better understood upon consideration of the following drawings and accompanying specification.

DESCRIPTION OF THE PREFERRED EMBODIMENT

Figure 1A:
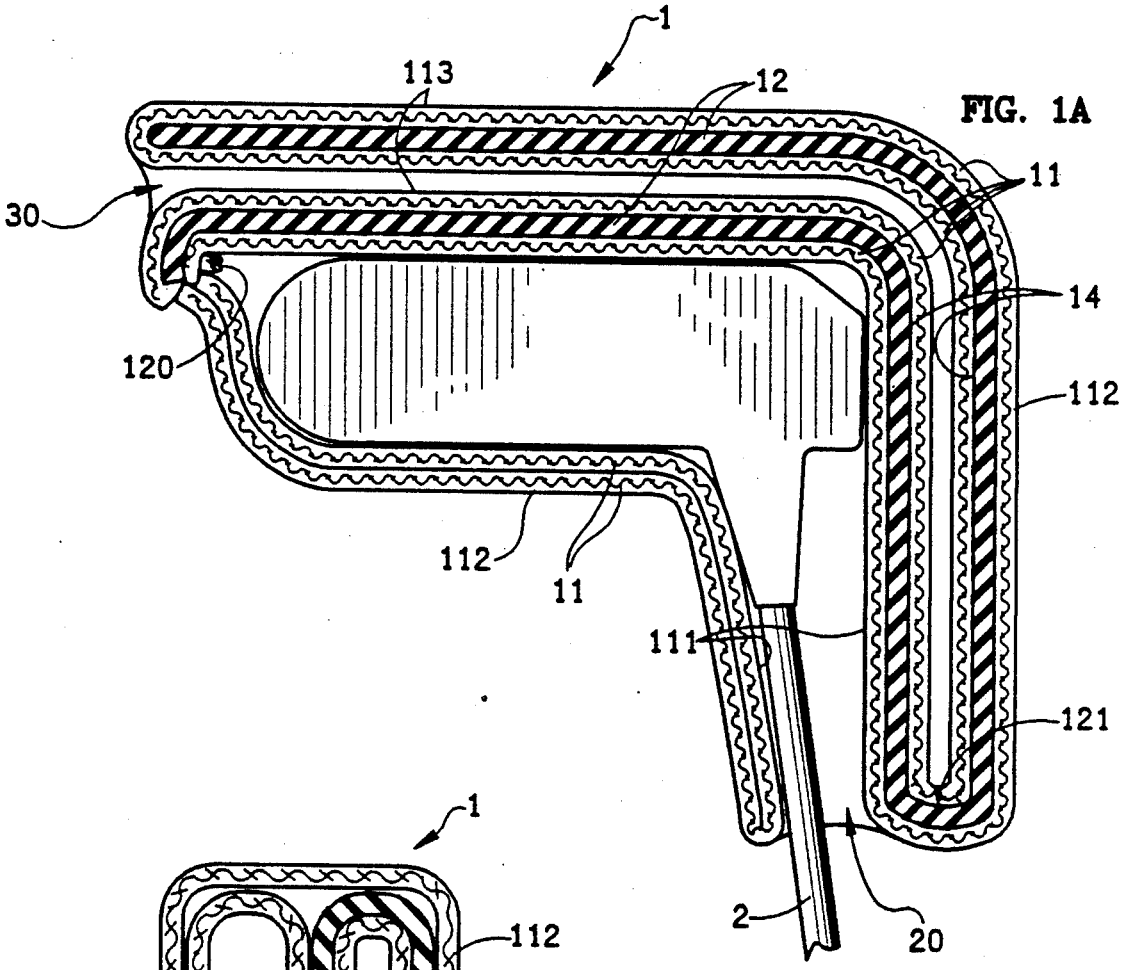
FIG 1A is a cross-sectional view of a preferred embodiment of a combination putter cover and golf ball washer in accordance with the present invention in its standby or storage position mounted to the head of a golf club.
Figure 2:
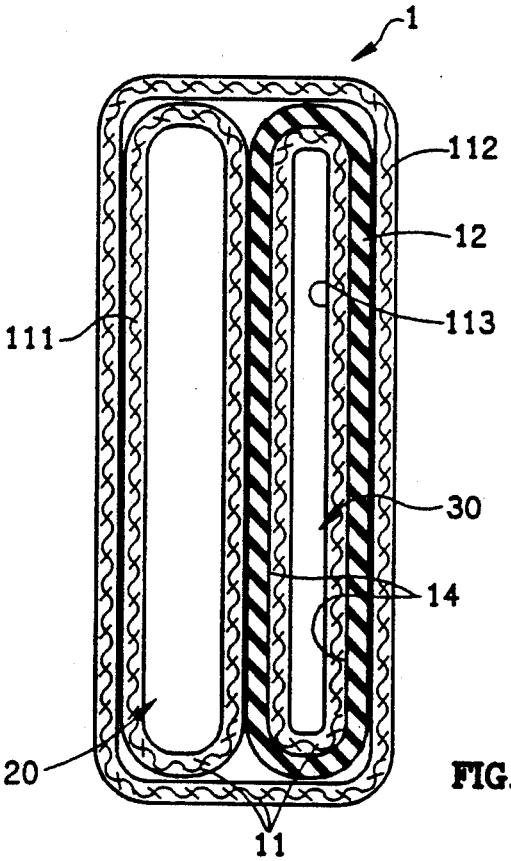
FIG. 2 is a cross-sectional end view, taken along line 2—2 of FIG 1B, showing the fabric and waterproof layers of the preferred embodiment of a combination putter cover and golf ball washer in accordance with the present invention.
Figure 1B:
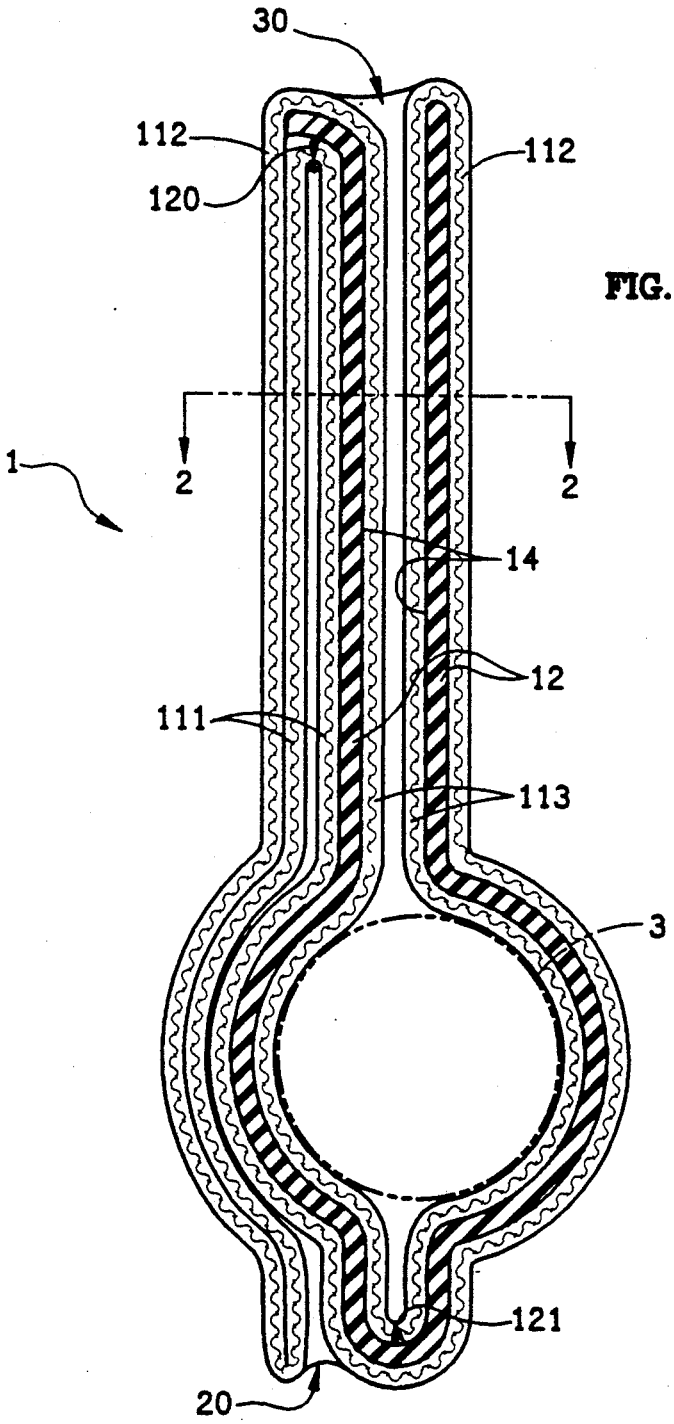
FIG 1B is another cross-sectional view of the preferred embodiment of the combination putter cover and golf ball washer in accordance with the present invention in use for washing a golf ball.

With reference now to FIGS. 1A, 1B and 2, there is illustrated a preferred embodiment of a combination putter cover and golf ball washer 1 in accordance with the present invention. The combination putter cover and golf ball washer 1 has a generally flattened cylindrical shape defined primarily by its two major components: a flexible fabric 11 and a moisture barrier, or bladder, 12.

The flexible fabric 11, which occupies the entire external and internal surfaces of the preferred embodiment of the present invention, is preferably made in its entirety primarily of knitted synthetic yarns. However, the preferred synthetic yarns, and the bulk if not also the type of the weave, preferably differ between three regions of the combination putter cover and golf ball washer 1.

The entire fabric 11 is topologically in the shape of an elongate tube. This tube is, during the course of assembly of the combination putter cover and golf ball washer 1, initially (or first) closed at one end, in the manner of a sock. The fabric tube is subsequently, at a later time during the course of assembly, closed at the remaining end, in the manner of a sausage casing. This basic topology of both the preferred embodiment of the combination putter cover and golf ball washer 1 shown in FIGS. 1A, 1B, 2, 3A through 3F, and a more rudimentary embodiment shown in FIGS. 4A through 4D, will become increasingly clear upon reference to the assembly drawings of FIGS. 3A through 3F and 4A through 4D—although the cylinder having double closed ends that constitutes the final topology of the fabric 11 can be traced even in FIGS. 1A and 1B.

The fabric 11 is preferably not homogeneous, but varies in both type and weave by areas. Two regions of the fabric 11, each of which regions occupies about one-third (⅓) of both the length and the area of the elongate tube, are preferably relatively more absorbent, and are more preferably made from acrylic yarn. The weave is, however, preferably different between these regions, being relatively higher and less dense in one region and relatively lower and more dense in the other region. The remaining region, approximately one-third (⅓) of the length and area of the elongate tube, is preferably less absorbent, and is preferably made from polyester yarn. Each of the three regions will be seen to be optimized to perform a particular purpose: 1) providing a visually- and tactilely-appealing high-bulk absorbent exterior surface, 2) providing a durable absorbent first interior surface for drying a wetted golf ball, and 3) providing a durable non-absorbent second interior surface for scrubbing clean a golf ball.

In particular, a first compartment 20 for containing a putter 2 (shown in phantom line in FIG 1A) is, in the preferred embodiment, made primarily from knitted acrylic yarn 111, and is tightly and densely knitted. This first region of the flexible fabric 11, being approximately one-third (⅓) of its overall lineal extent, is typically rolled over in the manner of a blind seam, and attached with a series of stitches 120. The stitches 120 are normally made with non-rotting synthetic thread, and may optionally additionally be made in conjunction with bias tape 13 (not shown in FIGS. 1A, 1B and 2; best seen in FIGS. 3A through 3F) in a manner that is conventional in sewed assembly. The sewed assembly forms a first closed end to the fabric 11 in the manner of a sock. This first closed end may, as an alternative to sewing, be knitted closed, again in the manner of a sock.

The first fabric region is particularly soft. It is suitable to protect and to lightly polish the head of the putter, or other golf club, 2. Meanwhile, the knitted acrylic yarn 111 of this first region is absorbent and will wick any water or moisture from within the first cavity 20, thereby helping to prevent rusting of the putter 2. In this property of absorbency the acrylic yarn 111 of the first region of fabric 11 will later be seen to be diametrically opposite to the properties of another, third, fabric region (to be discussed) that is within the same fabric 11.

The first fabric region of knitted acrylic yarn 11 is integrally connected, normally by seamless knitting, to a second region of flexible fabric 11.

This second region, again approximately one-third (⅓) the overall lineal extent of the flexible fabric 11, is preferably made from acrylic yarn 112 in a high-bulk weave. It occupies substantially the entire exterior of the combination putter cover and ball washer 1. It is substantially the only fabric yarn, and fabric region, of the combination putter cover and golf ball washer 1 that is visible to the eye. The acrylic yarn 112 is particularly visually and tactilely appealing to a purchaser and user of the combination putter cover and golf ball washer 1. It is desirably similar to high quality sock, and may have all manner of woven or sewed designs, and various colors, as are typical of woven socks. One particularly suitable acrylic yarn 111,112 is Orlon® brand acrylic yarn available from E. I. duPont de Nemours and Company, Delaware, U.S.A. ("Orlon" is a registered trademark of duPont).

Finally, a third region of flexible fabric 11, again approximately one-third (⅓) in lineal extent of the entire fabric 11, lines a second compartment 30 suitable to contain a golf ball 3 (shown in phantom line in FIG 1B), or other exterior object, for purpose of washing. The liner of this second compartment 30 is preferably made primarily of knitted polyester yarn 113. It is affixed together at its butt end, normally by sewing with stitches 121 which are again made with non-rotting synthetic thread. The closure of one end of the tube made from the fabric 11 by the stitches 120, and the other end by the stitches 121, imparts to such fabric 11 the topological shape of a double closed-end cylinder, or sausage, or hollow spheroid.

This third region is tough and mildly abrasive. It is relatively non-absorbent, and neither wicks water well nor dries easily. It is non-rotting when wet, and well-suited to scrub the exterior of a dirty golf ball. As is typical of polyester, it launders well.

The three regions of flexible fabric 11—one exterior region and two interior regions—may not appear precisely, or even approximately, identically-sized in FIG. 1A or 1B. That these regions are actually of the same, or approximately the same, lineal extent—each constituting approximately one-third (⅓) of the overall fabric 11—will become increasingly clear upon reference to the assembly drawings within FIGS. 3A through 3F and 4A through 4D. For the moment, it should be remembered that all regions of the fabric 11 may stretch, and that the cross-sectional views of FIGS. 1A, 1B and 2 will be enlarged, or diminished, in the areas and volumes of cavities 20 and 30 dependent upon, respectively, whether or nor a putter 2 or a golf ball 3 is temporarily respectively within, or without, the compartment.

The third region of flexible fabric 1, which region would otherwise be a formless and amorphous excess fold of fabric, is substantially formed into a pouch, or interior lining to the second compartment 30, because it is shaped by being placed within a flexible moisture barrier 12. The flexible moisture barrier 12 thus defines both the second, ball-washing, compartment 30, and also the opening to such compartment 30, that are each suitable to receive the golf ball 3. The opening, and the diameter, of the flexible moisture barrier 12 are, when combined with its fabric liner, appropriately sized so as to be snug about a golf ball 3 that is inserted within the compartment even though such insertion is easy, and so also is the manipulation of the golf ball 3 within the compartment 30. The ball 3 will typically not fall from an inserted position within the compartment 30 under force of gravity, and will, instead, remain stuck within the compartment 30 until extruded therefrom under mild pressure force from the fingers.

The moisture barrier 12 is preferably a waterproof molded neoprene bladder, generally rectangular in shape, with walls that are relatively thin—on the order of 0.5 millimeter (0.02 inches)—and with a cross-sectional circumference which is approximately 25% greater than the circumference of a standard golf ball. The rectangular moisture barrier, or bladder, 12 forms a chamber which, when laid flat, is approximately 20 centimeters (7⅞ inches) long by 7.3 centimeters (2⅞ inches) wide. The chamber is molded so as to lie substantially flat for ease of transport and storage when assembled into the combination putter cover and golf ball washer 1. However, the sidewalls are typically separated by approximately 0.6 centimeters (¼ inch) to permit the easy insertion of that end one-third section of the fabric tube 11 which is made of the woven polyester yarn 113. The bladder is, of course, open on one end only.

When the moisture barrier 12 in the shape of a bladder is so open at only one end, and is so sized and shaped such that the final one-third region of fabric 11 will fit precisely and exactly within it, then it will provide the substantial overall form to the combination putter cover and golf ball washer 1, and will retain its liner securely. The final one-third region of the fabric 11 may optionally be affixed to the moisture barrier 12 by adhesive 14. The adhesive 14 is in a thin, flexible, layer that is most substantially located on the major surface of the one-third region of the tube, and that is less substantially present in the region of stitches 121.

It may be alternatively be expressed that the fabric 11 is sized and shaped relative to the moisture barrier 12 so that the fabric's one-third region may be precisely contained within the compartment, or cavity, 30 that, as previously stated, is most substantially defined and established by the dimensions of the moisture barrier 12.

The moisture barrier 12 is in a relationship of approximately (i) 1:3 in lineal extent, (ii) 1:1 in circumference and diameter, and (iii) of similar, typically closed-end tubular, shape relative to the fabric 11. These relationships—which may be difficult or unfathomable from FIG. 1, and which, in the relationship of equal circumferences, is seemingly flatly contradicted by FIG. 2—will be made increasingly clear upon reference to the assembly drawings of FIGS. 3A through 3F and 4A through 4D. For the moment it is necessary to remember that each of the moisture barrier 12 and the fabric 11 are both flexible and, to a reasonable degree, stretchable. These two essential elements of the combination putter cover and golf ball washer are so shown selectively flexed and stretched in FIGS. 1A, 1B and 2.

Each of (i) the second, middle, and exteriorly-disposed region of the fabric 11 that is made from yarn 112, (ii) the adjacent first region that is made from yarn 111 and which forms a liner to the first compartment 20, and (iii) the adjacent third region that is made from yarn 113 and which forms a liner to the second compartment 30, are preferably integrally fabricated by machine weaving as a single tubular-shaped unit. The first region made from yarn 111 is approximately 7.6 centimeter (3 inches) wide when laid flat, and desirably tapers a slight bit toward the region of stitches 120. The second region made from yarn 112 is approximately 8¼ centimeters (3¼ inches) wide when laid flat. The third region made from yarn 113 is approximately 7⅛ centimeters (2⅞ inches) wide when laid flat, and desirably tapers a slight bit toward the region of stitches 121. The overall length of the fabric 11 formed as a tube is approximately 24 inches. A cylindrical knitting machine may conventionally construct such a tube from materials which can be selected from any of a variety of presently-available natural or man-made textile fibers.

In operation of the combination putter cover and golf ball cleaner for cleaning a golf ball a small amount, on the order of 7 to 10 milliliters (1.9 to 2.7 fluidram), of household detergent mixture of a type generally labeled as all-purpose-cleaner and typically available in containers with spray nozzles, is introduced into compartment 30, such that the lower portion of compartment 30 toward the second stitches 121 will be saturated. The mixture is held in the compartment 30 by the moisture barrier 12. Such mixture is introduced into compartment 30 at periodic intervals as needed, e.g., before play of a round of golf in which the combination putter cover and golf ball washer 1 is employed to wash a ball.

After insertion through the opening to compartment 30, a ball is manually urged to a position at or near the bottom of compartment 30 and near the second stitches 121. A user works exterior of the entire combination putter cover and golf ball washer 1 (the putter 2 now being removed) in a back and forth manner with his or her hands such that the entire surface of the golf ball 3 will come into contact with some of the saturated portion of the third region of the fabric 11, or the liner to compartment 30, to affect cleaning of the golf ball 3.

After cleaning of the golf ball 3 has been completed, the ball is urged out of compartment 30 through its neck opening. In doing this, the ball's surface will come into contact with some of the dry upper portion of the liner to compartment 30, thus removing most remaining moisture from the golf ball 3 by squeezing it off the surface of the ball. The golf ball 3, after expulsion from compartment 30, may be further dried, if necessary, by blotting its surface with the second, exterior, region of fabric 11, or even by insertion into compartment 20.

To facilitate use of the present invention as a decorative and protective putter cover, a head of a putter 2 is partially inserted the opening to compartment 20. The user grasps the exterior region of the fabric 11 near the opening to the fir-t compartment 20 and pulls the compartment 20 down and over the putter head such that the putter head is coaxed within, and is fully contained by, compartment 20. During this operation the first fabric region, woven from the yarn 111, stretches and conforms to the shape of the putter head, thus securing putter cover and ball washer 1 firmly on the putter head.

Figure 3A:
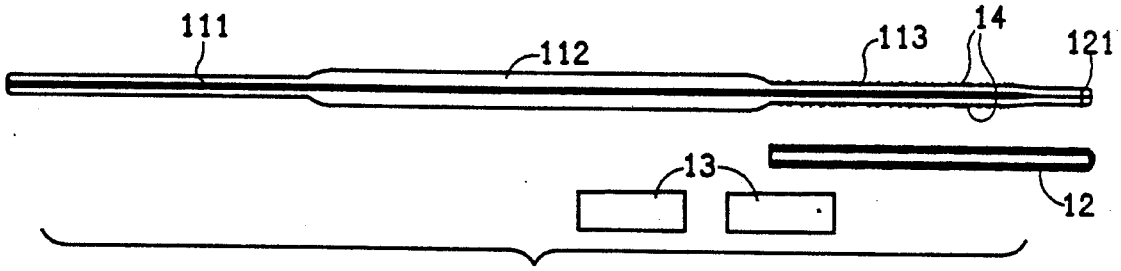
FIG. 3A through 3F, are sideways diagrams, partially in cross section, showing in sequence the initial components and the steps of (i) fitting, (ii) folding, (iii) rolling or first-reversing, (iv) sewing and trimming, and (v) second-reversing that are used in a preferred process in accordance with the present invention for producing the preferred embodiment of the combination putter cover and golf ball washer which was previously seen in FIGS. 1A, 1B and 2.
Figure 3B:
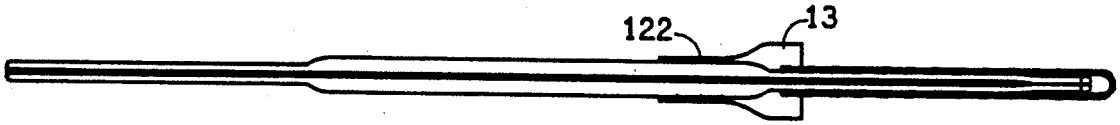
Figure 3C:
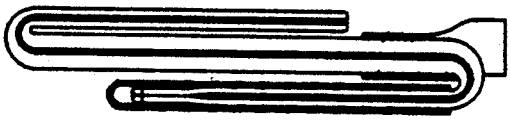
Figure 3D:
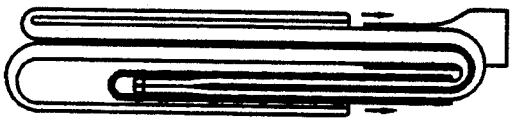
Figure 3E:
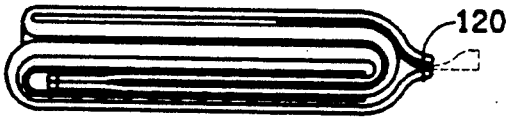
Figure 3F:
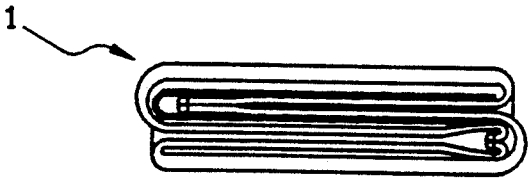

The preferred sequence of the assembly of the preferred embodiment of the combination putter cover and golf ball washer 1, previously seen in FIGS. 1A, 1B and 2, is shown in FIGS. 3A through 3F. Of the steps shown, the steps of FIG. 3B and of FIG. 3E are optional, but are preferably included. Another, similar but rudimentary, sequence of assembling a rudimentary golf ball cleaner 2—which rudimentary golf ball cleaner is a variant embodiment of the preferred combination putter cover and golf ball washer 1 (shown in FIGS. 1A, 1B, 2 and 3A through 3F) in accordance with the present invention—is shown in FIGS. 4A through 4D.

A tube of fabric 11 that is already knitted, or stitched by stitches 121, closed at one of its ends; a moisture barrier, or pouch 12; an optional two strips of bias tape 13; and optional adhesive 14 are shown in FIG. 3A as the basic parts of the preferred combination putter cover and golf ball washer 1. The elongate fabric tube with one closed end in the manner of a sock is larger than the flexible waterproof elongate bladder also with one closed end in the manner of a sock. The bladder has approximately the same cross-sectional area as the fabric tube and approximately one-third the length of the elongate fabric tube.

The major surfaces of the closed-end one-third region of the fabric 11 are lightly coated with an adhesive 14 suitable to flexibly bond fabric to synthetic rubber, normally by process of spraying.

The assembly method continues as shown in FIG. 3A by fitting the moisture barrier, or bladder, 12 over the closed-end one-third, polyester yarn 113, section of the elongated fabric tube, therein to contain the closed-end one-third section of the elongate fabric tube within the bladder. This "fitting" may, especially if the adhesive 14 proves tacky, be done by reversing the moisture barrier 12 onto the closed-end one-third region of the fabric 11. However, two more "reversing" are performed later in the preferred process, and the term "reversing" is reserved to describe those steps.

The two strips of bias tape 13 are rolled over the opposed edges of the combined fabric tube and bladder, and stitched in place by stitches 122, at the illustrated location near the bladder's opening.

Then, as is shown in FIG. 3B, both the bladder and the closed-end one-third section of the elongate tube therein contained are folded about an imaginary axis located across the elongate tube at a position approximately one-third of the tube's total length from its closed end so that both the bladder and the closed-end one-third section of the tube lie flat against a middle, acrylic yarn 112, one-third section of the elongate tube.

Continuing with the step shown in FIG. 3D, the open-end, densely-knitted acrylic yarn 111, one-third section of the elongate tube is rolled, or first reversed, over all of the (i) middle one-third section of the elongate tube, and also (ii) the bladder and the closed-end one-third section of the elongate tube that are jointly folded over and against said middle one-third section. Accordingly both (i) the bladder and (ii) the remaining two-thirds of the elongate tube become contained within this (presently) open-ended one-third section.

The lips of the fabric tube, and the bias tape strips that are now proximately positioned thereto, are next optionally sewn together with stitches 120 as is illustrated in FIG. 3E, thus closing shut the fabric tube at its second and final end.

Finally the open-end one-third section of the elongate tube, and all that it contains, is second reversed from its end that is opposite to the open-end of the elongate tube, thereby creating a combination putter cover and golf ball washer 1. The combination putter cover and golf ball washer 1 has (i) approximately one-third the length of the elongate tube, (ii) continuous fabric exposed to its exterior, and (iii) cavities of each end, one of which cavities contain the closed-end one-third section of the elongate fabric tube disposed to the inside of the bladder.

Figure 4A:
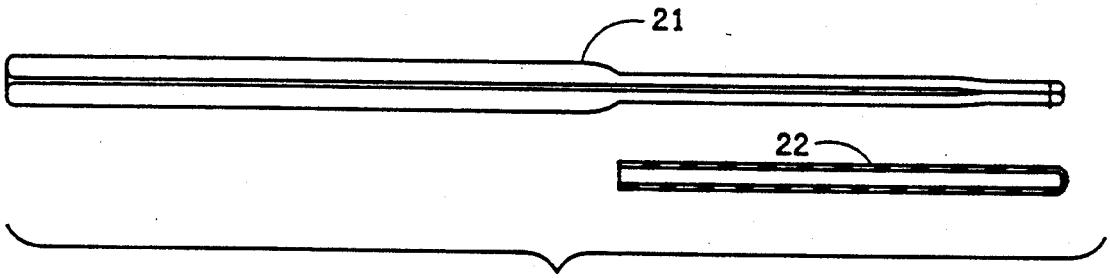
FIGS. 4A through 4D, are sideways diagrams, partially in cross section, showing in sequence the minimum initial components, and the basic steps of (i) fitting, (ii) folding, (iii) rolling or reversing, and (iv) affixing, typically by sewing, that are used in a basic, rudimentary, process in accordance with the present invention in order to produce a basic, rudimentary, golf ball cleaner in accordance with the present invention. Such a rudimentary golf ball cleaner, being a variant embodiment of the preferred putter cover and golf ball washer, is particularly shown in cross-sectional view in FIG. 4D.
Figure 4B:
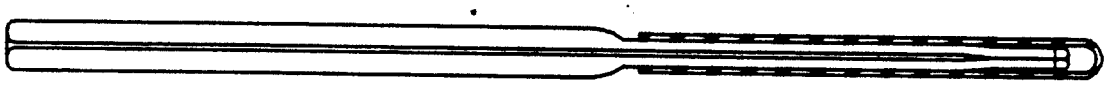
Figure 4C:
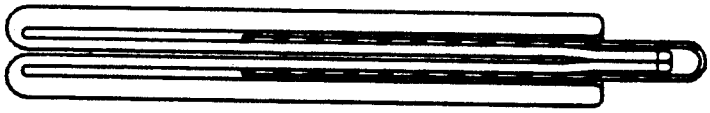

The stepwise assembly of a more rudimentary multi-layered elongate pouch for the manual cleaning of articles such as golf balls and the like is shown in FIGS. 4A through 4B. In order to distinguish this rudimentary embodiment of the present invention from the preferred embodiment of a combination putter cover and golf ball washer 1 that is shown in FIGS. 1A, 1B, 2 and 3A through 3F, it is called a "golf ball cleaner". The golf ball cleaner has no pouch for a putter 2 (shown in FIG 1A).

Figure 4D:
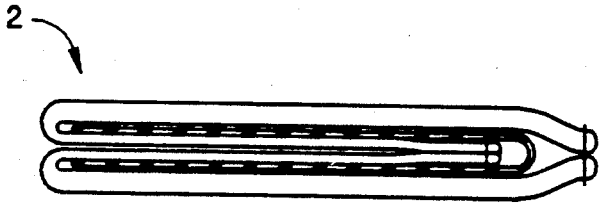

The basic fitting (and optional gluing of) the bladder over the closed end of the fabric tube"to three steps shown in FIGS. 4A through 4D are (i) fitting (and optional gluing of) a flexible elongate waterproof tubular bladder 22, over the closed end of a fabric tube 21 (FIG. 4B), (ii) reversing the fitted bladder and tube (FIG. 4C), and (iii) closing the remaining open end, normally by sewing (FIG. 4D). The product produced consists of the flexible waterproof elongate tubular bladder 22 having one closed end in the manner of a sock and having a length approximately equal to L; and the elongate fabric tube 21, having (i) a complimentary cross-section to the tubular bladder, (ii) a length of approximately 2L, and (iii) an end permanently closed and in the manner of a sock. The tubular bladder has been fitted over the closed end region of the fabric tube in the manner of a sheath, and may optionally be glued thereto (adhesive, or glue, not shown in FIGS. 4A through 4D). The remaining, unsheathed, region of the fabric tube is then reversed over the tubular bladder. This fitting and reversing forms an elongated pouch having an approximate length L, innermost and outermost layers of fabric, and a layer of flexible waterproof material between the innermost and outermost layers. Thread may be sewn through the fabric of the tube at its remaining open end, thereby to completely enclose the bladder within the fabric tube without detriment to its integrity to hold water.

Those skilled in the art will readily appreciate that the present invention provides golfers with a lightweight device which will be available for washing a golf ball, without regard for the availability or disposition of stationary ball washing equipments provided on golf courses. This device, by virtue of the textile materials used in its construction, does not require use of a separate towel or dangerous flammable drying agents to dry a wet ball. In addition, by virtue of waterproof materials used in its construction, it will not leak on hands clothing or equipment. Also, by virtue of the flexible materials used in its construction, it can be placed in a pocket or on a putter or otherwise be conveniently transported onto a putting green, or anyplace, where it might likely be needed. Furthermore, this device can itself be easily cleaned and maintained by machine washing and machine tumble drying along with other ordinary laundry items.

While the above description contains many specificities, these should not be construed as limitations on the scope of the invention, but rather as an exemplification of one preferred embodiment thereof. Many other variations are possible. For example, it can be produced in a variety of sizes, shapes, textures and colors; it can be constructed of various other textile fibers; the opening for putter and opening for ball can be positioned differently; the ball washing compartment lining can be rendered waterproof by coating with liquid neoprene or other synthetic rubber material; the neoprene bladder moisture barrier can be replaced by a polyethylene bag moisture barrier; it can be constructed using polyvinyl chloride plastic which can serve, simultaneously, as the moisture barrier and as the flexible exterior; any of a variety of fasteners, such as zippers, velcro, draw strings or snaps, can be used to facilitate or enhance its ability to cover and attach to a putter; and, it can be produced as exclusively a portable golf ball cleaner that does not contain a separate putter compartment.

Accordingly, the scope of the invention should be interpreted broadly, and in accordance with the following claims, and not merely by the embodiments illustrated.

What is claimed is:

1. A multi-layered generallyelongate double-end-opening pouch for cleaning articles such as golf balls and the like comprising:

at least an elongate fabric tube of length 3L, having at least one closed end in the manner of a sock, that is folded and rolled to a generally tubular form of approximately length L, the tubular form having and defining two separate cavities proceeding for the substantial entirety of the length L from openings at both ends, at least one of the defined cavities having a bottom that is closed because it is formed from the closed end of the elongate fabric tube from which the tubular form is folded and rolled; and a flexible waterproof elongate tubular bladder, also having at least one closed end in the manner of a sock and having a length approximately equal to L, that is completely contained within the folded and rolled tubular form of the fabric tube in a position exterior to, and sheathing, the at least one cavity which has a bottom that is closed; and means for absorbing or otherwise retaining a saturating fluid within the fabric of the at least one cavity having a bottom that is closed;

wherein the at least one cavity having a bottom that is closed will hold fluid because it is sheathed with the elongate bladder;

wherein the at least one cavity that will hold fluid may suitably be saturated with fluid, inserted with a foreign article, and manually massaged to provide a cleaning action to the foreign article;

wherein the remaining cavity that proceeds from the remaining open end of the tubular form is suitably sized and shaped so as to slip over the head of a golf club thereafter to retain both the tubular form and also the bladder to the head of said golf club.

2. The pouch according to claim 1 wherein the fabric tube consists essentially of:

a region of relatively less absorbent yarn; and a region of relatively more absorbent yarn.

3. The pouch according to claim 2 wherein the relatively more absorbent yarn consists essentially of:

acrylic; and wherein the relatively less absorbent yarn consists essentially of; polyester.

4. The pouch according to claim 1 wherein the fabric tube is of woven construction.

5. The pouch according to claim 1 wherein the bladder consists essentially of:

neoprene rubber.

6. A combination golf club cover and golf ball washer comprising:

a flexible waterproof pouch;

flexible fabric completely internally lining and externally covering the waterproof pouch;

the fabric-lined and fabric-covered pouch defining a first cavity suitable to receive a golf ball and a cleaning solution so as to thereafter be externally manually manipulated in order to clean the golf ball by contact with the lining of the pouch in the presence of the cleaning solution; and a second, flexible fabric, pouch formed from a unitary extension of at least part of the external fabric covering of the waterproof pouch and at least one additional flexible fabric layer, each connected to the other so as to define a second cavity suitable for receiving the head of a golf club.

7. The combination putter cover and golf ball washer according to claim 6 wherein the flexible fabric comprises:

a relatively non-absorbent yarn lining the waterproof pouch; and a relatively absorbent yarn covering the waterproof pouch; and wherein the at least one additional flexible fabric layer of the second fabric pouch comprises;

a relatively absorbent yarn.

* * * * *